United States Patent [19]

Schnizler et al.

[11] Patent Number: 4,690,226

[45] Date of Patent: Sep. 1, 1987

[54] HAMMER DRILL

[75] Inventors: Albrecht Schnizler; Manfred Schulz, both of Nürtingen; Klaus Bartmann, Neuffen-Kappishäusern, all of, Fed. Rep. of Germany

[73] Assignee: Metabowerke GmbH & Co., Nürtingen, Fed. Rep. of Germany

[21] Appl. No.: 864,738

[22] Filed: May 12, 1986

Related U.S. Application Data

[63] Continuation of Ser. No. 645,846, Aug. 29, 1984, abandoned.

[30] Foreign Application Priority Data

Sep. 5, 1983 [DE] Fed. Rep. of Germany ..... 3331866
Jul. 7, 1984 [EP] European Pat. Off. ..... 84107973.4

[51] Int. Cl.[4] ..... B25D 17/08

[52] U.S. Cl. ..... 173/128; 173/133; 175/414

[58] Field of Search ..... 173/128, 133, 139; 175/414, 415; 408/226

[56] References Cited

U.S. PATENT DOCUMENTS 2,956,783 10/1960 Landstedt ..... 175/414 X
3,865,198 2/1975 Price ..... 173/133
4,131,165 12/1978 Wanner et al. ..... 173/133 X

*Primary Examiner*—E. R. Kazenske
*Assistant Examiner*—Willmon Fridie, Jr.
*Attorney, Agent, or Firm*—Michael J. Striker

[57] ABSTRACT

A hammer drill has clamping jaws which are provided, in addition to clamping surfaces for radial clamping a cylindrical tool shaft, also with additional axially extending guiding surfaces for axially non-rotatably holding and guiding of the tool shaft, and the tool shaft is provided with guiding grooves associated with the clamping jaws.

6 Claims, 11 Drawing Figures

FIG. 2
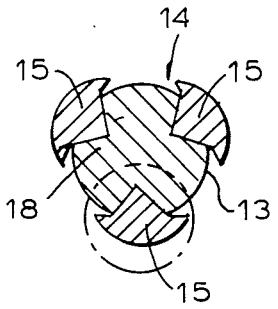
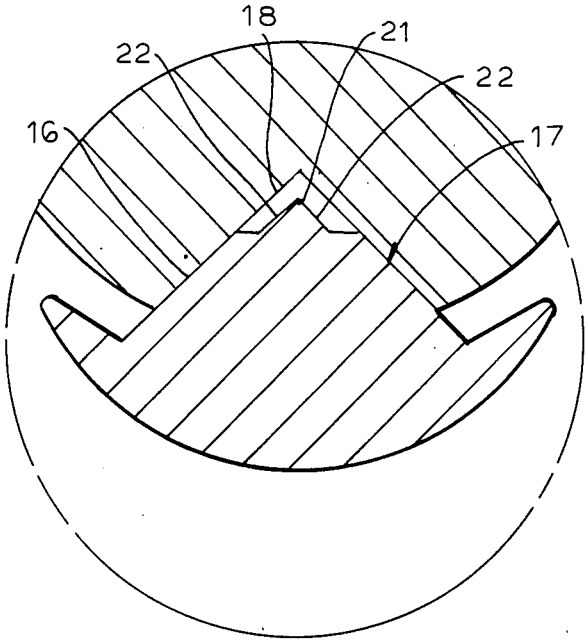
FIG. 3

HAMMER DRILL

This is a continuation of application Ser. No. 645,846, filed Aug. 29, 1984, now abandoned.

BACKGROUND OF THE INVENTION

The present invention relates to a hammer drill. More particularly, it relates to a hammer drill which has a guiding cylinder for a strike mechanism and a guiding pipe for an envil acting upon a tool shaft of a tool formed as a rotary drill. A drill chuck is held on a guiding pipe and extending outwardly beyond a housing and is provided for radial clamping of the tool shaft with at least three displaceable clamping jaws with clamping surfaces for the tool shaft. A rotary drive is provided for the guiding pipe at least for impact drilling.

A hammer drill of the above-mentioned general type is known in the art. One of such hammer drills is disclosed, for example, in the DE-OS No. 3,132,450. Here the drill chuck is arranged fixedly on the guiding pipe. The drill must be inserted into the drill chuck for attaining an unobjectionable clamping, and must have an exact diameter and during impacting drilling operation the anvil strikes both against the tool end and also against the clamping jaws. Even with a small wear or high manufacturing tolerances an unobjectionable clamping and a good rotation are no longer guaranteed.

Another hammer drill is disclosed in the DE-OS No. 2,842,783. Here a drill chuck is disclosed with which the rotary drill with a cylindrical shaft and a hammer drill with a special shaft can be clamped with a profiled cross-section. The hammer drill is not completely clamped because of the axial movability required for transmission of the impact. This known chuck is inserted with the aid of its special shaft in the conventional tool receptacle of a hammer drill which is provided with a play and thereby the exact rotation required for the rotary drill cannot be guaranteed.

The DE-OS Nos. 3,125,444 and 3,125,455 also disclose a hammer drill for drilling and impacting drilling operations in which the tool with a specially shaped shaft is displaceable in an axial direction, but prevented from rotation. However, only tools with a predetermined shaft diameter can be clamped here. The same is true also for a tool holder in accordance with the DE-OS Nos. 1,652,684 and 2,551,125.

SUMMARY OF THE INVENTION

Accordingly, it is an object of the present invention to provide a hammer drill which avoids the disadvantages of the prior art.

More particularly, it is an object of the present invention to provide a hammer drill which both for pure drilling of a rotary drill with a cylindrical shaft can be reliably and fixedly clamped, the same is for the hammer drill with a profiled shaft which for impact drilling is longitudinally displaceable, but prevented from rotation by the chuck.

In keeping with these objects and with others which will become apparent hereinafter, one feature of the present invention resides, briefly stated, in a hammer drill in which clamping jaws, in addition to clamping surfaces for radical clamping of a cylindrical tool shaft directly or indirectly have additionally axially extending guiding surfaces for only axially unrotatably holding and guiding shaft of a tool, and the tool shaft is provided with respective axes parallel guiding grooves directly or indirectly associated with the clamping jaws.

It is especially advantageous when the clamping surfaces of the clamping jaws are offset so that they do not abut against the shaft of the tool having the guiding grooves, and the radial clamping which allows an axial displacement but does not allow a relative rotation as well as guidance of the shaft is obtained by the mutually corresponding surfaces of the clamp jaws and the guiding grooves.

With fixed clamping of a rotary drill, during forced turning of the tool insignificant deformations and damages of the clamped surfaces of the clamping jaws can take place. When these clamped surfaces are used also for axially displaceable receipt of the hammer drills, the axial displaceability would be endangered by the insignificant deformations of the clamping surfaces. During coarse operation with impact drilling the clamping jaws are relatively strongly worn by the penetrating rock millings. The thus worn guiding surfaces can no longer guarantee central clamping of a drill shaft. With the proposed separation of the clamping surfaces and the guiding surfaces these disadvantages are reiably eliminated.

It is especially advantageous when the guiding surfaces are formed by two surfaces extending at an angle relative to one another, and the shaft of the tool is centered by these surfaces cver its guiding grooves and is guided in an axially displaceable and non-rotatable manner. It is especially advantageous and favorable for transmission of higher torques and at the same time reliable longitudinal guidance, when the angle between the surfaces amounts to approximately 90%, wherein the guiding grooves of the tool shaft are formed as corresponding triangular grooves.

In known manner, the clamping surfaces of a clamping jaw can be formed by surfaces extending at an angle relative to one another and connected by a rounded transition. It is advantageous when these further surfaces extend parallel to the surfaces of the additional guiding surfaces of the tool shaft and are offset relative to the same. By the offset back arrangement, a protection of the guiding surfaces is obtained. Small deformations of the clamping surfaces during clamping of a cylindrical shaft do not affect the guiding surfaces, so that a reliable longitudinal displaceability of the tool during the impact drilling is guaranteed.

In hammer drills it is known that the tools with different working diameters have the same shaft shape to provide a simple exchange. The tool receptacles have, however, a relative play so that the tool is not exactly guided. For clamping in accordance with the invention also small tools or tools with different shaft shape, it is possible in an advantageous manner to provide the tool shaft with a profiled cross-section, on which an axially displaceable adapter sleeve with respective inner cross-section and a cylindrical outer surface is arranged. The adapter sleeve can be fixedly clamped in the drill chuck. During impact drilling operation the strikes acting in an axial direction do not act against the drill chuck.

For preventing falling-out of the tool shaft from the adapter sleeve it can be displaceably guided between two abutments of the tool shaft, whereby a conventional displacement of approximately 10–15 mm for the impact drilling operation is sufficient.

A very simple construction is obtained for easy exchangeability when at least one of the abutments is formed as a clamping ring engaged in a circumferential groove.

It is advantageous when the abutments are formed by the ends of the guiding grooves which do not extend up to the end of the shaft.

In accordance with a further feature of the present invention, a counter abutment in the adapter sleeve is formed by a ball arranged in a transverse bore so as to be engaged in a longitudinal spline of the shaft and to be held in engagement by a wall of the passage of the drilled chuck body. The abutment can be provided at the end of the longitudinal spline. For easy handling, the ball can be secured from falling-out by wedging of the ends of the transverse bore.

In accordance with another embodiment of the invention, in addition to at least one longitudinal spline, at least one guiding groove can extend up to the shaft end and be provided with an inwardly projecting web corresponding to the cross-section of the adapter sleeve.

For sparing parts instead of the transverse bore and the ball, at least one projection punched out inwardly of the sleeve wall can be provided as a counter abutment.

In accordance with still another embodiment of the invention the tool shaft can be displaceably guided in the adapter sleeve clamped within the clamping jaws. The tool shaft has a profiled cross-section at least at its end region, and the drill chuck body at the end of its opening is provided with a receiving profile corresponding to the profile cross-section of the tool shaft so as to make possible an axial displacement of the tool, but prevent a rotation relative to the drill chuck body.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 2 is a view showing a section taken along the line II—II in FIG. 1 and showing a tool clamp;

FIG. 3 is a partial view of a section taken in FIG. 2, on an enlarged scale;

DESCRIPTION OF THE PREFERRED EMBODIMENTS

Figure 1:
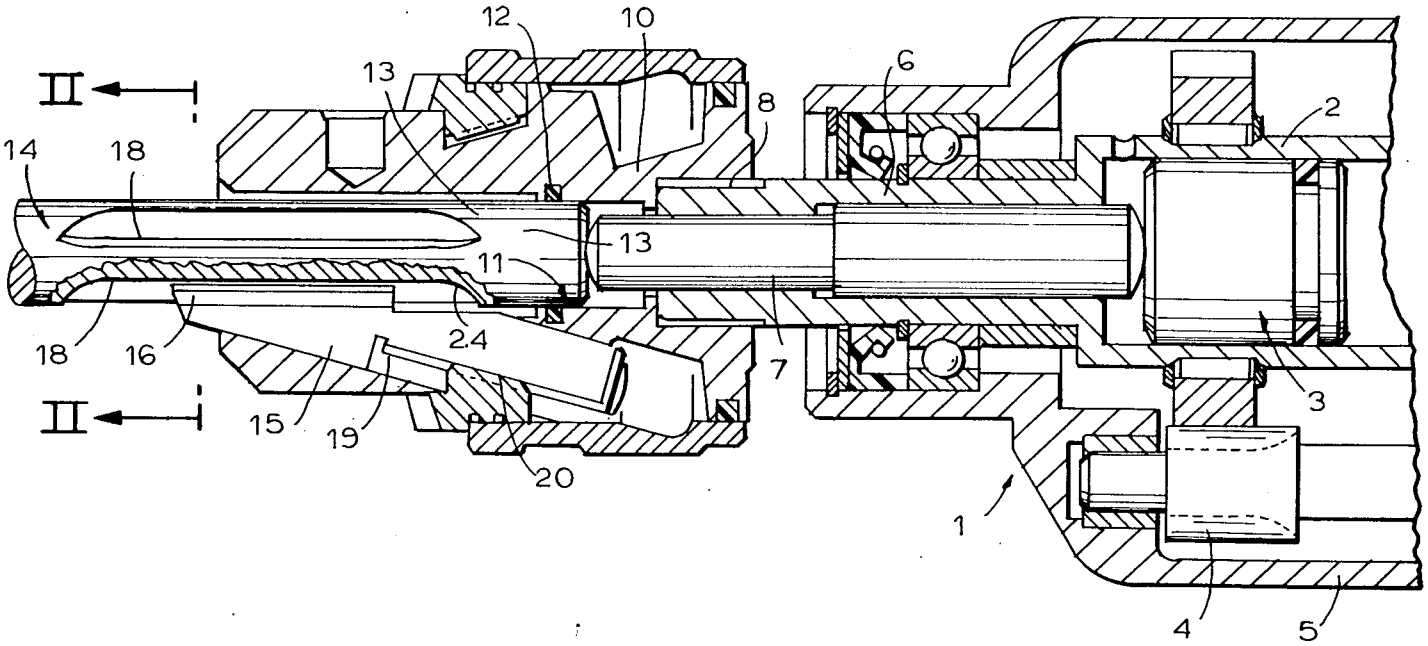
FIG. 1 is a partial longitudinal view of a hammer drill in accordance with the present invention.

In all embodiments, the same reference numerals are used for the same parts of the inventive hammer drill.

Reference numeral 1 identifies a hammer drill in accordance with the present invention which is only partially shown in the drawing. The hammer drill 1 has a guiding cylinder 2 for an impact mechanism 3 rotatable by a rotary drive 4. A guiding pipe 6 is fixedly connected with the guiding cylinder 2 and extends outwardly of a housing 5. An anvil 7 is movably guided in the guiding pipe 6 and impacted by the impacting mechanism 3 in an axial direction.

The guiding pipe 6 has an end portion which extends outwardly beyond the housing 5. This portion is provided with a thread 8. A drill chuck 9 is screwed on the thread 8 of the end portion of the guiding pipe 6.

The drill chuck 9 has a drill chuck body 10 with an axially extending passage 11. A seal 12 is arranged in the passage 11 for preventing dirt entry and seals a shaft 13 of the tool 14. The tool 14 is held centrally in the drill chuck 9 by three circumferentially distributed clamping jaws 15. For making possible an impact drilling operation, the shaft 13 is displaceable in an axial direction by a predetermined distance, but a rotation in a rotary direction is impossible because of the clamping jaws 15. For this purpose, the clamping jaws have a substantially triangular cross-section and form surfaces 16 which extend relative to one another at an angle of approximately 90° which are guided in respective guiding grooves 18 of the tool 14 and together constitute a guiding surface 17. This is shown particularly in FIG. 3.

In the embodiments of FIGS. 1–3, the tool 14 is an impact drilling tool. It is driven by impacting drilling drive through the anvil 7 in an axial direction with rotation through the rotary drive 4 by strikes of the striking mechanism 3, so as to increase the drilling efficiency by these strikes in a known manner.

For obtaining the axial displaceability of the tool shaft 13, the clamping jaws 15 which are movable by a clamping cone 19 via a thread 20 are fixedly clamped so that an axial displacement is possible during the impacting drilling operation and at the same time an axial guidance is guaranteed.

For clamping a normal rotary drill with a cylindrical shaft, the clamping jaws 15 have clamping surfaces 21 which are formed by two further surfaces 22 which extend at an angle relative to one another and are connected via a round transition. These further surfaces 22 are offset from the surfaces 16, but extend parallel to the latter. Therefore the clamping surfaces 21 in the impacting drilling tools do not abut against the bottom of the groove 18 and thereby are not subjected to any wear during the impacting drilling operation. Further, damages to the clamping surfaces 16 cannot lead to damages of the groove 18 and accurate axial guidance.

Figure 4:
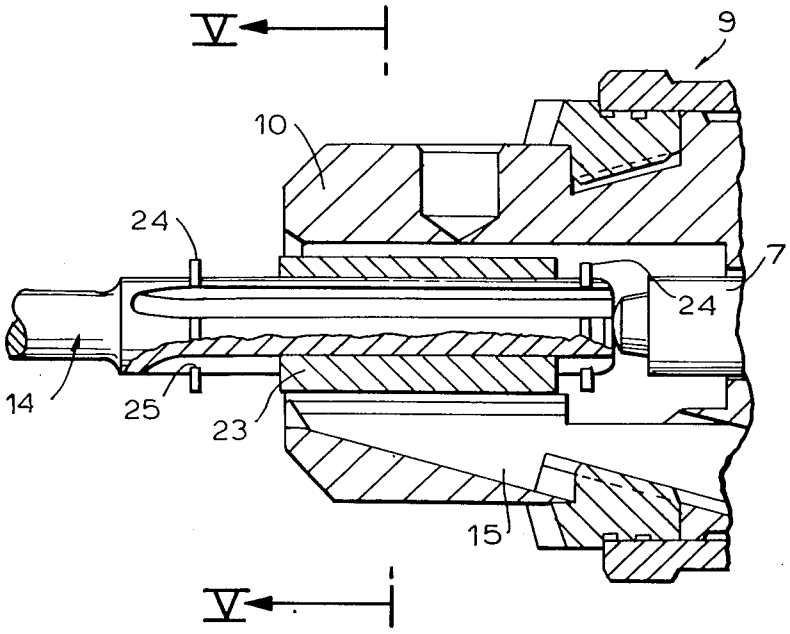
FIG. 4 is a partial section taken through a drill chuck with another tool design.
Figure 5:
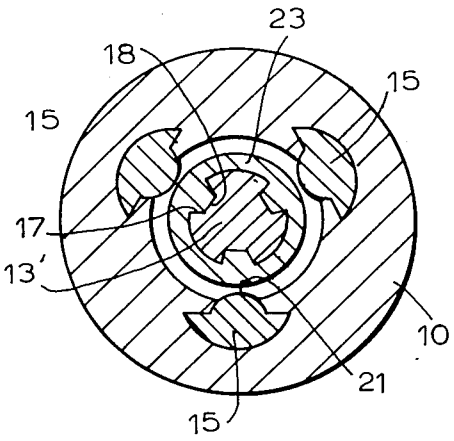
FIG. 5 is a view showing a section taken of the drill chuck taken along the line V—V in FIG. 4.

FIGS. 4 and 5 show clamping of a tool formed as an impacting drilling tool. Its clamping shaft is provided with another profile which does not correspond to the jaws 15. A tool shaft 13' has a splined cross-section, and a sleeve 23 with a respective cross-section is arranged axially displaceably on the tool shaft 13'. The axial displaceability is limited by an abutment 24 formed as a clamping ring arranged in a groove 25. The sleeve 23 is fixedly held by the clamping jaws 15, whereas for impacting drilling the shaft 13' of the tool 14 is movable in an axial direction in the sleeve 23 so that the impacts of the anvile 7 cannot act on the drill chuck 9. The stroke of the anvil 7 is so limited that with abutment of the abutment 24 against the inner side of the sleeve 23 no impact can be longer transmitted.

In the embodiments of FIGS. 1–3 the guiding grooves 18 correspond to the triangular shape of the guiding surfaces 17, whereas in the embodiment of FIGS. 4–5 a trapezoidal shape of the guiding surfaces 17 and the guiding grooves 18 is provided.

With the proposed construction of the drill chuck 9, both a rotary drilling tool and an impact drilling tool can be clamped as the tool 14, and the same tool formed as a hammer drill can be used for an aligning exact drilling and for the conventional impact drilling.

Thereby, the tool equipment on the construction sites is simplified.

Figure 7:
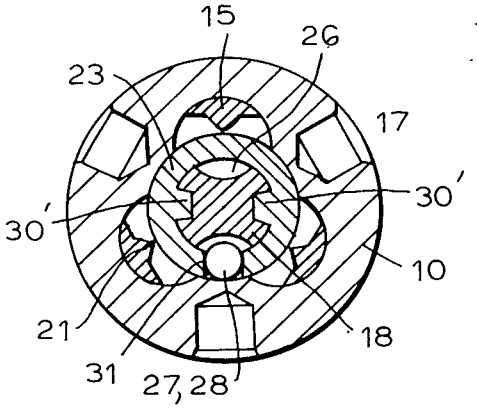
FIGS. 6–11 are longitudinal and transverse sections of the hammer drill in accordance with three further embodiments.
Figure 6:
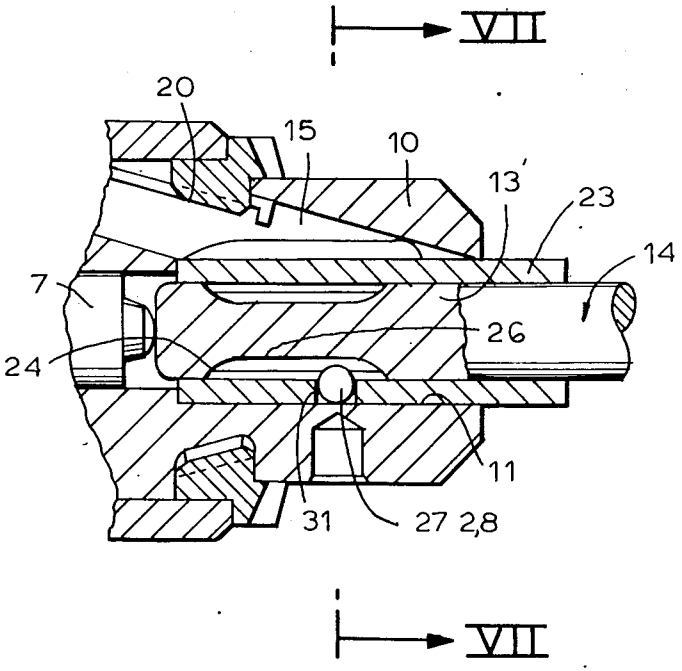

In the embodiment shown in FIGS. 6 and 7, the shaft 13' of the tool 14 has symmetrically two guiding grooves 18 and two longitudinal splines 26. The longitudinal splines 26 do not extend entirely up to the shaft end so that in the end region these longitudinal splines 26 form an abutment 14 for a ball 27 of a counter abutment 28. The ball 27 is arranged in a transverse bore 29 of the adapter sleeve 23 and secured from falling out by wedging over of the ends of the transverse bore.

The diameter of the ball 27, the adapter sleeve thickness and the depth of the longitudinal splines 26 is dimensioned so that with the adapter sleeve 23 inserted in the passage 11 of the drill chuck the ball 27 is held by the bore wall in engagement in the longitudinal spline 26. Thereby the tool 14 cannot be pulled axially out of the adapter sleeve 23, but instead this maximum pulling out of the ball 27 butment against the abutment 24. The axial displaceability is so great that the anvil 7 in its full functioning region can cooperate with the shaft 13'. The adapter sleeve 23 which is passingly received in the passage 11 of the drill chuck body 10 is fixedly clamped by the clamping jaws 15 without preventing the axial movement of the tool 14 in the stroke region of the longitudinal splines 26.

Figure 9:
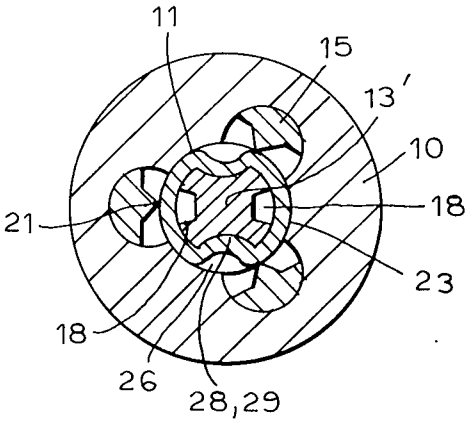
Figure 8:
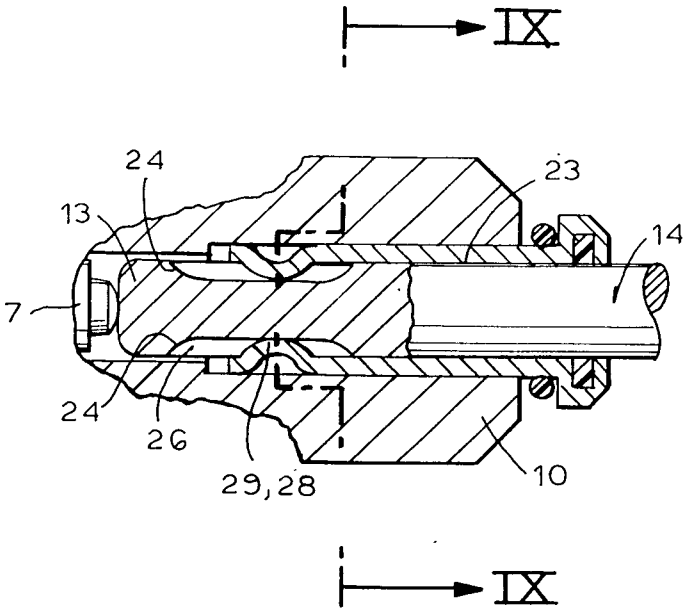

In the embodiment of FIGS. 8 and 9, instead of the ball 27 in the wall of the adapter sleeve 23, a projection 29 is punched out at each side symmetrically and forms, together with the longitudinal spline 26, a counter abutment 28. The longitudinal spline 26 has an end facing toward the drill chuck and forming the abutment 24 which cooperates with the projections 29 and thence falling out of the adapter sleeve 23 held between the clamping jaws 15.

Figure 11:
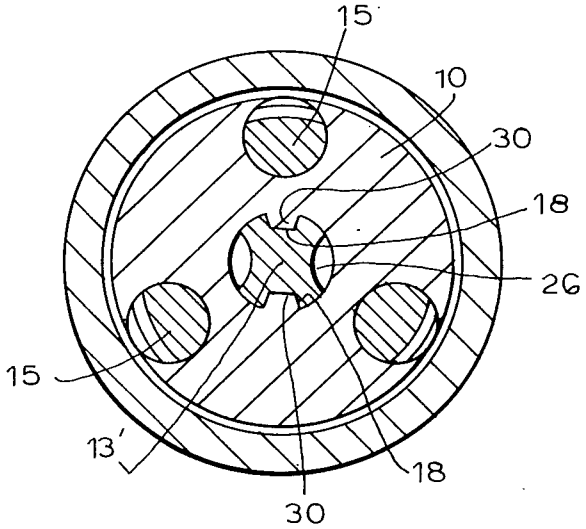
Figure 10:
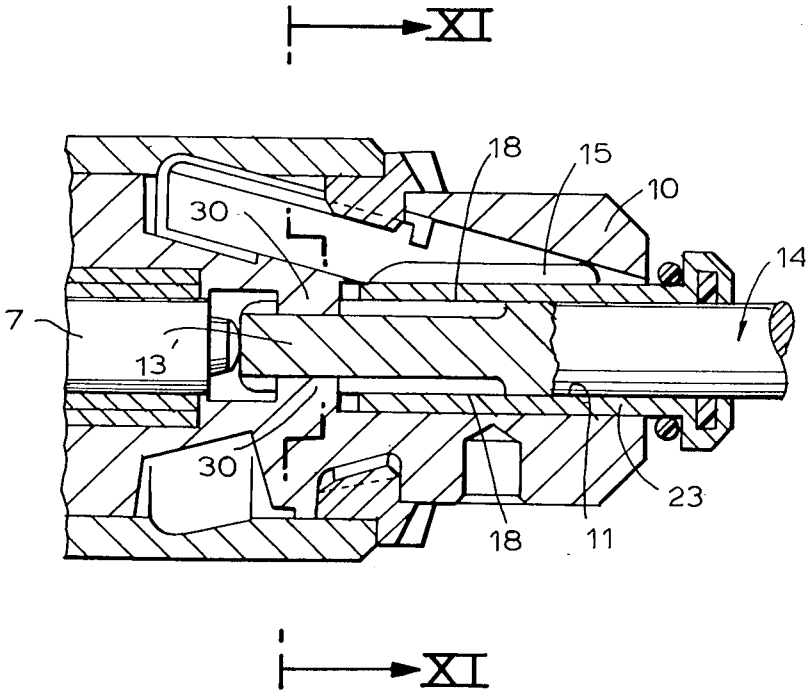

In this embodiment the sleeve 23 cannot be inserted on the clamped shaft of the tool, it must be centrally subdivided for insertion of the projections 29 into the longitudinal splines 26, transverse to the plane of the projections. The rotary-fixed driving of the tool is performed by a direct form-locking connection 30 between the shaft end of the tool and the drill chuck body, as can be seen in FIGS. 10 and 11.

It will be understood that each of the elements described above, or two or more together, may also find a useful application in other types of constructions differing from the types described above.

While the invention has been illustrated and described as embodied in a hammer drill it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A tool for a hammer drill comprising a tool shaft having a profiled cross-section; and an adapter sleeve axially displaceable on said tool shaft and having an inner cross-section corresponding to said profiled cross-section of said tool shaft and also having a cylindrical outer surface, said outer cylindrical surface being fixedly clampable by clamping surfaces of clamping jaws, said profiled cross-section of said tool shaft having at least guiding grooves, said adapter sleeve having inwardly extending guiding surfaces cooperating with said guiding grooves, said tool shaft having two abutments, said adapter sleeve being arranged to be displaceable between said two abutments of said tool shaft.

2. A tool as defined in claim 1, wherein said tool shaft has a circumferential groove, at least one of said abutments being formed as a clamping ring inserted in said circumferential groove.

3. A tool as defined in claim 1, wherein said tool shaft has an end, said guiding grooves do not extend to said end of the tool shaft so as to form one of said abutments.

4. A tool as defined in claim 1, wherein said adapter sleeve has a transverse bore and a counter abutment formed as a ball arranged in said transverse bore, said tool shaft having a longitudinal spline in which said ball engages and held in engagement by a wall of the passage of the drill chuck body, said longitudinal spline has an end forming one of said abutments.

5. A tool as defined in claim 4, wherein said tool shaft has an end and said guiding groove extends to said end, said adapter sleeve having an inwardly projecting web corresponding to the cross-section of said guiding groove.

6. A tool as defined in claim 4, wherein said adapter sleeve has a counter abutment formed by an inwardly punched-out projection.

* * * * *